US005885765A

United States Patent [19]

Horsten et al.

[11] Patent Number: 5,885,765

[45] Date of Patent: Mar. 23, 1999

[54] THERMOGRAPHIC RECORDING MATERIAL WITH IMPROVED TONE REPRODUCTION

[75] Inventors: Bartholomeus Horsten, Rumst; Vankeerberghen An, Borgerhout; Leenders Luc, Herentals, all of Belgium

[73] Assignee: Agfa-Gevaert, Mortsel, Belgium

[21] Appl. No.: 773,974

[22] Filed: Dec. 26, 1996

Related U.S. Application Data

[60] Provisional application No. 60/011,313 Feb. 8, 1996.

[30] Foreign Application Priority Data

Dec. 27, 1995 [EP] European Pat. Off. ..... 95203634

[51] Int. Cl.[6] ..... B41M 5/28; B41M 5/40; G03C 1/494; G03C 1/498

[52] U.S. Cl. ..... 430/619; 430/617; 430/618; 430/620; 430/315; 430/236; 503/202; 503/210; 503/207; 503/226

[58] Field of Search ..... 430/617, 618, 430/619, 620, 351, 236; 503/202, 210, 207, 226

[56] References Cited

U.S. PATENT DOCUMENTS

| | | | |
|---|---|---|---|
| 4,013,473 | 3/1977 | Willems et al. | 96/114 |
| 5,489,566 | 2/1996 | Dombrowski | 503/207 |
| 5,578,548 | 11/1996 | Bjork et al. | 503/202 |
| 5,652,195 | 7/1997 | Horsten et al. | 503/226 |

FOREIGN PATENT DOCUMENTS

| | | |
|---|---|---|
| 7525962 | 3/1976 | France . |
| 193035 | 10/1979 | Poland . |

OTHER PUBLICATIONS

Korczynski, Andrzej, et al., "Heat–sensitive paper for obtaining black–and–white reproductions," *Radiation Chem., Photochem.* 91:58 (1979) (Abstract only).

English abstract to French Patent Application No. 75 25962, published Mar. 19, 1976.

*Primary Examiner*—Marian C. Knode
*Assistant Examiner*—Mary K. Zeman
*Attorney, Agent, or Firm*—Baker & Botts, L.L.P.

[57] ABSTRACT

A recording material for producing high contrast images comprising at least one thermosensitive element, comprising a layer comprising a substantially light-insensitive organic silver salt in at least one binder and in thermal working relationship therewith an organic reducing agent therefor, on a support, characterized in that the recording material is light-insensitive and the layer contains colloidal particles comprising silicon dioxide at a coating weight given by expression (1):

$$0.015 \times \frac{B}{AGOS} < \frac{S}{AGOS} < 1.2 \frac{(B}{AGOS} - 0.4) \quad (1)$$

wherein B represents the total weight of all binders in the layer, AGOS represents the total weight of organic silver salt in the layer and S represents the weight of the colloidal particles in the layer; and wherein a protective layer is optionally applied to the thermosensitive element being thereby an outermost layer of the recording material.

10 Claims, No Drawings

THERMOGRAPHIC RECORDING MATERIAL WITH IMPROVED TONE REPRODUCTION

This application is a continuation of Provisional application Ser. No. 60/011,313, filed Feb. 8, 1996.

FIELD OF THE INVENTION

The present invention relates to a thermographic material suitable for thermal development. In particular, it concerns improvements in tonal reproduction due to its thermosensitive element having a particular composition.

BACKGROUND OF THE INVENTION

Thermal imaging or thermography is a recording process wherein images are generated by the use of imagewise modulated thermal energy.

A survey of "direct thermal" imaging methods is given e.g. in the book "Imaging Systems" by Kurt I. Jacobson-Ralph E. Jacobson, The Focal Press—London and New York (1976), Chapter VII under the heading "7.1 Thermography". Direct thermal thermography is concerned with materials which are substantially not photosensitive, but are sensitive to heat or thermosensitive. Imagewise applied heat is sufficient to bring about a visible change in a thermosensitive imaging material.

Most of the "direct" thermographic recording materials are of the chemical type. On heating to a certain conversion temperature, an irreversible chemical reaction takes place and a coloured image is produced.

According to U.S. Pat. No. 3,080,254 a typical heat-sensitive (thermographic) copy paper includes in the heat-sensitive layer a thermoplastic binder, e.g ethyl cellulose, a water-insoluble silver salt, e.g. silver stearate and an appropriate organic reducing agent, of which 4-methoxy-1-hydroxy-dihydronaphthalene is a representative. Localized heating of the sheet in the thermographic reproduction process, or for test purposes by momentary contact with a metal test bar heated to a suitable conversion temperature in the range of about 90°–150° C., causes a visible change to occur in the heat-sensitive layer. The initially white or lightly coloured layer is darkened to a brownish appearance at the heated area. In order to obtain a more neutral colour tone a heterocyclic organic toning agent such as phthalazinone is added to the composition of the heat-sensitive layer. Thermo-sensitive copying paper is used in "front-printing" or "back-printing" using infra-red radiation absorbed and transformed into heat in contacting infra-red light absorbing image areas of an original as illustrated in FIGS. 1 and 2 of U.S. Pat. No. 3,074,809.

In direct thermal imaging the image quality is strongly dependent upon the tone response of the direct thermal recording material to the heating pulses image-wise applied to the heat source and in particular the dependence of image density upon the power input to the heat source. Fine tuning of the response of the material enables image quality to be obtained whether continuous tone images are desired, for which a fairly large number of grey levels are required and therefore a moderately flat response is necessary, or graphics imaging is desired, requiring a single image tone and a very strong dependence of image density upon the power input to the heat source.

In EP-A 687 572 the incorporation of certain ingredients is disclosed, which enable the tone response (=image density) of a direct thermal recording material to the power input to the heat source to be made flatter thereby enabling a fairly large of grey levels to be attained, as required for continuous tone images. However, a means of steepening the response of direct thermal recording materials is equally desirable, but has not yet been found.

OBJECTS OF THE INVENTION

It is therefore an object of the invention to provide a means of steepening the dependence of image density of direct thermal imaging materials upon the power input to the heat source.

It is a further object of the invention to provide a process utilizing a recording material with a steeper dependence of image density of direct thermal imaging materials upon the power input to the heat source.

Further objects and advantages of the invention will become apparent from the description hereinafter.

SUMMARY OF THE INVENTION

The above mentioned objects are realised by a recording material comprising at least one thermosensitive element, comprising a layer comprising at least one substantially light-insensitive organic silver salt in at least one binder and in thermal working relationship therewith an organic reducing agent therefor, on a support, characterized in that the recording material is light-insensitive and the layer contains colloidal particles comprising silicon dioxide at a coating weight given by expression (1):

$$0.015 \times \frac{B}{AGOS} < \frac{S}{AGOS} < 1.2 \frac{(B}{AGOS} - 0.4) \quad (1)$$

wherein B represents the weight of all binders in the layer, AGOS represents the weight of all organic silver salts in the layer and S represents the weight of the colloidal particles in the layer.

The above objects are also realized by a thermal image forming process for producing high contrast images comprising the steps of: (i) bringing an outermost layer of a recording material as described above; (2) applying heat from a heat source image-wise to the recording material while maintaining mutual contact to the heat source; and (3) separating the recording material from the heat source.

Preferred embodiments of the invention are disclosed in the dependent claims.

DETAILED DESCRIPTION OF THE INVENTION

According to preferred embodiment a thermal image forming process, according to the present invention, is realized, wherein the heat source is a thermal head.

According to a particularly preferred embodiment a thermal image forming process, according to the present invention, is realized, wherein the heat source is a thin film thermal head.

According to further preferred embodiment of the recording material, according to the present invention, the layer contains the colloidal particles at a coating weight given by expression (2):

$$0.1 \times \frac{B}{AGOS} < \frac{S}{AGOS} < 1.0 \left( \frac{B}{AGOS} - 0.4 \right) \quad (2)$$

wherein B represents the weight of all binders in the layer, AGOS represents the weight of all organic silver salts in the layer and S represents the weight of colloidal particles in the layer.

According to particularly preferred embodiment of the recording material, according to the present invention, the layer contains the colloidal particles at a coating weight given by expression (3):

$$0.2 \times \frac{B}{AGOS} < \frac{S}{AGOS} < 0.8\left(\frac{B}{AGOS} - 0.4\right) \quad (2)$$

wherein B represents the weight of all binders in the layer, AGOS represents the weight of all organic silver salts in the layer and S represents the weight of the collidal particles in the layer.

According to another preferred embodiment, according to the present invention, the recording material has a haze value, determined according to ASTM standard D1003 procedure B, of less than 35%.

Colloidal particles comprising silicon dioxide

Preferred types of colloidal particles comprising silicon dioxide are those that are hydrophobized thereby making them readily dispersible in the binders of the layer comprising at least one light-insensitive organic silver salt without substantially reducing the transparency of the recording layer of the present invention.

Preferred types of colloidal particles comprising silicon dioxide, according to the present invention, have specific surface areas of less than 100 $m^2/g$.

Particularly preferred types of colloidal particles comprising silicon dioxide, according to the present invention, are hydrophobized grades of amorphous flame hydrolyzed silica for example Aerosil™ R812 and Aerosil™ R972 from Degussa AG.

Outermost layer

The outermost layer of the recording material may in different embodiments of the present invention be the outermost layer of the thermosensitive element, a protective layer applied to the thermosensitive element or a layer on the opposite side of the support to the thermosensitive element.

Protective layer

The outermost layer surface layer of the recording material according to the present invention may be a protective layer applied to the thermosensitive element to avoid local deformation of the thermosensitive element and to improve resistance against abrasion.

The protective layer preferably comprises a binder, which may be hydrophobic (solvent soluble) of hydrophilic (water soluble). Among the hydrophobic binders polycarbonates as described in EP-A 614 769 are particularly preferred. However, hydrophilic binders are preferred for the protective layer, as coating can be performed from an aqueous composition and mixing of the hydrophilic protective layer with the immediate underlayer can be avoided by using a hydrophobic binder in the immediate underlayer.

A protective layer according to the present invention may comprise in addition a thermomeltable particle optionally with a lubricant present on top of the protective layer as described in WO 94/11199. In a preferred embodiment at least one solid lubricant having a melting point below 150° C. and at least one liquid lubricant in a binder is present, wherein at least one of the lubricants is a phosphoric acid derivative. Examples of suitable lubricating materials are surface active agents, liquid lubricants, solid lubricants which do not melt during thermal development of the recording material, solid lubricants which melt (thermomeltable) during thermal development of the recording material or mixtures thereof. The lubricant may be applied with or without a polymeric binder. The surface active agents may be any agents known in the art such as carboxylates, sulfonates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol and fatty acids.

Such protective layers may also comprise particulate material, e.g. talc particles, optionally protruding from the protective outermost layer as described in WO 94/11198. Other additives can also be incorporated in the protective layer e.g. colloidal particles such as colloidal silica.

Hydrophilic binder for outermost layer

According to an embodiment of the present invention the outermost layer of the recording material may comprise a hydrophilic binder. Suitable hydrophilic binders for the outermost layer are, for example, gelatin, polyvinylalcohol, cellulose derivatives or other polysaccharides, hydroxyethylcellulose, hydroxypropylcellulose etc., with hardenable binders being preferred and polyvinylalcohol being particularly preferred.

Crosslinking agents for outermost layer

The outermost layer according to the present invention may be crosslinked. Crosslinking can be achieved by using crosslinking agents such as described in WO 95/12495 for protective layers, e.g. tetra-alkoxysilanes, polyisocyanates, zirconates, titanates, melamine resins etc., with tetraalkoxysilanes such as tetramethylorthosilicate and tetraethylorthosilicate being preferred.

Matting agents for outermost layer

The outermost layer of the recording material according to the present invention may comprise a matting agent. Suitable matting agents are described in WO 94/11198 and include e.g. talc particles and optionally protrude from the outermost layer.

Lubricants for outermost layer

Solid or liquid lubricants or combinations thereof are suitable for improving the slip characteristics of the recording materials according to the present invention.

Solid lubricants which can be used according to the present invention are polyolefin waxes e.g. polypropylene waxes, ester waxes e.g. fatty acid esters, polyolefin-polyether block copolymers, amide waxes e.g. fatty acid amides, polyglycols e.g. polyethylene glycol, fatty acids, fatty alcohols, natural waxes and solid phosphoric acid derivatives.

Preferred solid lubricants are thermomeltable particles such as those described in WO 94/11199 e.g. fatty acid esters, polyolefin-polyether block copolymers and fatty acid amides. Preferred fatty acid esters are glycerine monostearate, glycerine monopalmitate and mixtures of glycerine monostearate and glycerine monopalmitate. Preferred fatty acid amides are selected from the group consisting of ethylenebisstearamide, stearamide, oleamide, myristamide and erucamide.

Liquid lubricants which can be used according to the present invention according to the present invention are fatty acid esters such as glycerine trioleate, sorbitan monooleate and sorbitan trioleate, silicone oil derivatives and phosphoric acid derivatives such as {mono[isotridecyl polyglycolether (3 EO)]phosphate}, {mono[isotridecyl polyglycolether (6 EO)]phosphate}, {mono[oleyl polyglycolether (7 EO)]phosphate} and {mono[oleyl polyglycolether (7 EO)] phosphate}.

Thermosensitive element

The thermosensitive element, according to the present invention comprises a substantially light-insensitive organic silver salt and an organic reducing agent therefor in thermal working relationship therewith. The element may comprise a layer system in which the ingredients may be dispersed in different layers, with the proviso that the substantially light-insensitive organic silver salt and the organic reducing agent are in thermal working relationship with one another i.e. during the thermal development process the reducing agent must be present in such a way that it is able to diffuse to the substantially light-insensitive organic silver salt particles so that reduction of the organic silver salt can take place.

Organic silver salts

Preferred organic silver salts according to the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, with silver behenate being particularly preferred. Such silver salts are also called "silver soaps". In addition silver dodecyl sulphonate described in U.S. Pat. No. 4,504,575; and silver di-(2-ethylhexyl)-sulfosuccinate described in EP-A 227 141, modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677.

Reducing agents

Suitable organic reducing agents for the reduction of the substantially light-insensitive organic silver salts are organic compounds containing at least one active hydrogen atom linked to O, N or C, such as is the case with, aromatic di- and tri-hydroxy compounds; aminophenols; METOL (tradename); p-phenylenediamines; alkoxynaphthols, e.g. 4-methoxy-1-naphthol described in U.S. Pat. No. 3,094,41; pyrazolidin-3-one type reducing agents, e.g. PHENIDONE (tradename); pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378.

Among useful aromatic di- and tri-hydroxy compounds having at least two hydroxy groups in ortho- or para-position on the same aromatic nucleus, e.g. benzene nucleus, hydroquinone and substituted hydroquinones, catechol, pyrogallol, gallic acid and gallic acid esters are preferred. Particularly useful are polyhydroxy spiro-bis-indane compounds, especially these corresponding to the following general formula (I):

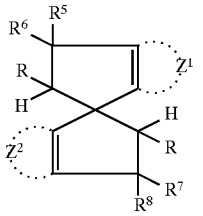

(I)

wherein

R represents hydrogen or alkyl, e.g. methyl or ethyl, each of $R^5$ and $R^6$ (same or different) represents, an alkyl group, preferably methyl group or a cycloalkyl group, e.g. cyclohexyl group, each of $R^7$ and $R^8$ (same or different) represents, an alkyl group, preferably methyl group or a cycloalkyl group, e.g. cyclohexyl group, and each of $Z^1$ and $Z^2$ (same or different) represents the atoms necessary to close an aromatic ring or ring system, e.g. benzene ring, substituted with at least two hydroxyl groups in ortho- or para-position and optionally further substituted with at least one hydrocarbon group, e.g an alkyl or aryl group.

In particular are mentioned the polyhydroxy-spiro-bis-indane compounds described in U.S. Pat. No. 3,440,049 as photographic tanning agent, more especially 3,3,3',3'-tetramethyl-5,6,5',6'-tetrahydroxy-1,1'-spiro-bis-indane ( called indane I) and 3,3,3',3'-tetramethyl-4,6,7,4',6',7'-hexahydroxy-1,1'-spiro-bis-indane (called indane II). Indane is also known under the name hydrindene.

Among the catechol-type reducing agents, i.e. reducing agents containing at least one benzene nucleus with two hydroxy groups (—OH) in ortho-position, the following are preferred: catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters. Particularly preferred catechol-type reducing agents, described in EP-A 692 733, are benzene compounds in which the benzene nucleus is substituted by no more than two hydroxy groups which are present in 3,4-position on the nucleus and have in the 1-position of the nucleus a substituent linked to the nucleus by means of a carbonyl group.

The silver image density depends on the coverage of the above defined reducing agent(s) and organic silver salt(s) and has to be preferably such that, on heating above 100° C., an optical density of at least 2.5 can be obtained. Preferably at least 0.10 moles of reducing agent per mole of organic silver salt is used.

Auxiliary reducing agents

The above mentioned reducing agents being considered as primary or main reducing agents may be used in conjunction with so-called auxiliary reducing agents. Such auxiliary reducing agents are e.g. sterically hindered phenols, that on heating become reactive partners in the reduction of the substantially light-insensitive organic silver salt such as silver behenate, such as described in U.S. Pat. No. 4,001,026; or are bisphenols, e.g. of the type described in U.S. Pat. No. 3,547,648. The auxiliary reducing agents may be present in the imaging layer or in a polymeric binder layer in thermal working relationship thereto.

Preferred auxiliary reducing agents are sulfonamidophenols corresponding to the following general formula $$\text{Aryl—SO}_2\text{—NH—Arylene—OH}$$

in which:

Aryl represents a monovalent aromatic group, and

Arylene represents a bivalent aromatic group, having the —OH group preferably in para-position to the —$SO_2$—NH— group.

Sulfonamidophenols according to the above defined general formula are described in the periodical Research Disclosure, February 1979, item 17842, in U.S. Pat. Nos. 4,360,581 and 4,782,004, and in published European Patent Application No. 423 891, wherein these reducing agents are mentioned for use in a photo-thermographic recording material in which photo-sensitive silver halide is present in catalytic proximity to a substantially light-insensitive silver salt of an organic acid.

Other auxiliary reducing agents that may be used in conjunction with the above mentioned primary reducing agents are organic reducing metal salts, e.g. stannous stearate described in U.S. Pat. No. 3,460,946 and 3,547,648.

Polycarboxylic acids and anhydrides thereof

According to the recording material of the present invention the thermosensitive element may comprise in addition at least one polycarboxylic acid and/or anhydride thereof in a molar percentage of at least 20 with respect to all the organic silver salt(s) present and in thermal working relationship therewith. The polycarboxylic acid may be aliphatic (saturated as well as unsaturayed aliphatic and also cycloaliphatic) or an aromatic polycarboxylic acid. These acids may be substituted e.g. with alkyl, hydroxyl, nitro or halogen. They may be used in anhydride form or partially esterified on the condition that at least two free carboxylic acids remain or are available in the heat recording step.

Particularly suitable are saturated aliphatic dicarboxylic acids containing at least 4 carbon atoms, e.g. : succinic acid, glutaric acid, adipic acid, pimelic acid, suberic acid, azelaic acid, sebacic acid, nonane-dicarboxylic acid, decane-dicarboxylic acid, undecane-dicarboxylic acid.

Suitable unsaturated dicarboxylic acids are : maleic acid, citraconic acid, itaconic acid and aconitic acid. Suitable polycarboxylic acids are citric acid and derivatives thereof, acetonedicarboxylic acid, iso-citric acid and α-ketoglutaric acid.

Preferred aromatic polycarboxylic acids are ortho-phthalic acid and 3-nitro-phthalic acid, tetrachlorophthalic acid, mellitic acid, pyromellitic acid and trimellitic acid and the anhydrides thereof.

Film-forming binders of the thermosensitive element

The film-forming binder of the thermosensitive element containing the substantially light-insensitive organic silver salt may be all kinds of natural, modified natural or synthetic resins or mixtures of such resins, wherein the organic silver salt can be dispersed homogeneously: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

A particularly suitable polyvinyl butyral containing a minor amount of vinyl alcohol units is marketed under the trade name BUTVAR™ B79 of Monsanto USA and provides a good adhesion to paper and properly subbed polyester supports The binder to organic silver salt weight ratio is preferably in the range of 0.2 to 6, and the thickness of the recording layer is preferably in the range of 5 to 50 μm.

The layer containing the organic silver salt is commonly coated onto a support in sheet- or web-form from an organic solvent containing the binder dissolved therein, but may be applied from an aqueous medium as a latex, i.e. as an aqueous polymer dispersion. For use as a latex the dispersible polymer has preferably some hydrophilic functionality. Polymers with hydrophilic functionality for forming an aqueous polymer dispersion (latex) are described e.g. in U.S. Pat. No. 5,006,451, but serve therein for forming a barrier layer preventing unwanted diffusion of vanadium pentoxide present as an antistatic agent.

The above mentioned binders or mixtures thereof may be used in conjunction with waxes or "heat solvents" also called "thermal solvents" or "thermosolvents" improving the reaction speed of the redox-reaction at elevated temperature.

By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic silver salt, at a temperature above 60° C. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1,1-dioxide, methyl anisate and 1,10-decanediol being described as heat solvents in Research Disclosure, December 1976, (item 15027) pages 26–28. Still other examples of heat solvents have been described in U.S. Pat. Nos. 3,438,776, and 4,740,446, and in published EP-A 0 119 615 and 0 122 512 and DE-A 3 339 810.

Toning agents

In order to obtain a neutral black image tone in the higher densities and neutral grey in the lower densities the recording layer contains preferably in admixture with the organic silver salts and reducing agents a so-called toning agent known from thermography or photo-thermography.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type within the scope of following general formula:

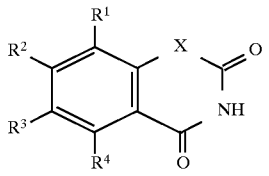

in which:

X represents 0 or N-alkyl;

each of $R^1$, $R^2$, $R^3$ and $R^4$ (same or different) represents hydrogen, alkyl, e.g. C1–C20 alkyl, preferably C1–C4 alkyl, cycloalkyl, e.g. cyclopentyl or cyclohexyl, alkoxy, preferably methoxy or ethoxy, alkylthio with preferably up to 2 carbon atoms, hydroxy, dialkylamino of which the alkyl groups have preferably up to 2 carbon atoms or halogen, preferably chlorine or bromine; or $R^1$ and $R^2$ or $R^2$ and $R^3$ represent the ring members required to complete a fused aromatic ring, preferably a benzene ring, or $R^3$ and $R^4$ represent the ring members required to complete a fused aromatic aromatic or cyclohexane ring. Toners within the scope of the general formula are described in GB-P 1,439,478 and U.S. Pat. No. 3,951,660.

A toner compound particularly suited for use in combination with polyhydroxy benzene reducing agents is 3,4-dihydro-2,4-dioxo-1,3,2H-benzoxazine described in U.S. Pat. No. 3,951,660.

Other ingredients

The recording layer may contain in addition to the ingredients mentioned above other additives such as free fatty acids, surface-active agents, antistatic agents, e.g. non-ionic antistatic agents including a fluorocarbon group as e.g. in $F_3C(CF_2)_6CONH(CH_2CH_2O)$—H, silicone oil, e.g. BAYSILONE™ Öl A (from BAYER AG, GERMANY), ultraviolet light absorbing compounds, white light reflecting and/or ultraviolet radiation reflecting pigments and/or optical brightening agents.

Support

The support for the thermal imaging material according to the present invention may be transparent, translucent or opaque, e.g. having a white light reflecting aspect and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. For example, a paper base substrate is present which may contain white reflecting pigments, optionally also applied in an interlayer between the recording material and the paper base substrate.

The support may be in sheet, ribbon or web form and subbed if need be to improve the adherence to the thereon coated thermosensitive recording layer. The support may be made of an opacified resin composition, e.g. polyethylene terephthalate opacified by means of pigments and/or microvoids and/or coated with an opaque pigment-binder layer, and may be called synthetic paper, or paperlike film; information about such supports can be found in EP's 194 106 and 234 563 and U.S. Pat. Nos. 3,944,699, 4,187,113, 4,780,402 and 5,059,579. Should a transparent base be used, the base may be colourless or coloured, e.g. having a blue colour.

One or more backing layers may be provided to control physical properties such as curl and static.

Antistatic layer

In a preferred embodiment the recording material of the present invention an antistatic layer is applied to the outermost layer not comprising at least one solid lubricant having a melting point below 150° C. and at least one liquid lubricant in a binder, wherein at least one of the lubricants is a phosphoric acid derivative. Suitable antistatic layers therefor are described in EP-A 440 957.

Coating

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, NY 10010, U.S.A.

Processing configurations

As described in "Handbook of Imaging Materials", edited by Arthur S. Diamond—Diamond Research Corporation—Ventura, Calfornia, printed by Marcel Dekker, Inc. 270 Madison Avenue, New York, New York 10016 (1991), p. 498–502 in thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place. The operating temperature of common thermal printheads is in the range of 300° to 400° C. and the heating time per picture element (pixel) may be 50 ms or less, the pressure contact of the thermal printhead with the recording material being e.g. 100–500 g/cm$^2$ to ensure a good transfer of heat.

In order to avoid direct contact of the thermal printing heads with a recording material not provided with an outermost protective layer, the imagewise heating of the recording material with the thermal printing heads may proceed through a contacting but removable resin sheet or web wherefrom during the heating no transfer of recording material can take place.

In a particular embodiment of the method according to the present invention the direct thermal image-wise heating of the recording material proceeds by Joule effect heating in that selectively energized electrical resistors of a thermal head array are used in contact or close proximity with the recording layer. Suitable thermal printing heads are e.g. a Fujitsu Thermal Head (FTP-040 MCS001), a TDK Thermal Head F415 HH7-1089 and a Rohm Thermal Head KE 2008-F3.

The image signals for modulating the current in the micro-resistors of a thermal printhead are obtained directly e.g. from opto-electronic scanning devices or from an intermediary storage means, e.g. magnetic disc or tape or optical disc storage medium, optionally linked to a digital image work station wherein the image information can be processed to satisfy particular needs.

When used in thermographic recording operating with thermal printheads the recording materials will not be suited for reproducing images with fairly large number of grey levels as is required for continuous tone reproduction.

According to EP-A 622 217 relating to a method for making an image using a direct thermal imaging element, improvements in continuous tone reproduction are obtained by heating the thermal recording element by means of a thermal head having a plurality of heating elements, characterized in that the activation of the heating elements is executed line by line with a duty cycle Δ representing the ratio of activation time to total line time in such a way that the following equation is satisfied:

$$P \leq P_{max} = 3.3\ W/mm^2 + (9.5\ W/mm^2 \times \Delta)$$

wherein $P_{max}$ is the maximal value over all the heating elements of the time averaged power density P (expressed in W/mm$^2$) dissipated by a heating element during a line time.

Direct thermal imaging can be used for both the production of transparencies and reflection type prints. Application of the present invention is envisaged in the fields of both graphics images requiring high contrast images with a very steep print density applied dot energy dependence and continuous tone images requiring a weaker print density applied dot energy dependence, such as required in the medical diagnostic field. In the hard copy field recording materials on a white opaque base are used, whereas in the medical diagnostic field black-imaged transparencies are widely used in inspection techniques operating with a light box.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appending claims.

The invention is illustrated hereinafter by way of invention examples and COMPARATIVE EXAMPLES. The percentages and ratios given in these examples are by weight unless otherwise indicated. The ingredients used in these examples are:

* as organic silver salt: silver behenate represented in the examples by AgBeh;
* as binder: polyvinyl butyral (BUTVAR™ B79) represented in the examples by PVB;
* as reducing agent: butyl 3,4-dihydroxyhenzoate represented by R1;
* as toning agent: benzo[e][1,3]oxazine-2,4-dione represented by TA1;
* as levelling agent: silicone oil (Baysilone™ from Bayer AG) represented by oil;
* as stabilizers:
  tetrachlorophthalic anhydride represented by S1;
  pimelic acid represented by S2;
* as gradation increasing agent:
  Aerosil™ R812 (hydrophobic silicon dioxide) represented by R812;
  Aerosil™ R972 (hydrophobic silicon dioxide) represented by R972;

INVENTION EXAMPLES 1 TO 3 AND COMPARATIVE EXAMPLE 1

A subbed polyethylene terephthalate support having a thickness of 175 μm was doctor blade-coated from a coating composition containing butanone as a solvent and the following ingredients so as to obtain thereon, after drying for 1 hour at 50° C., layers with the compositions given in tables 1 and 2 for the COMPARATIVE EXAMPLE and INVENTION EXAMPLES respectively.

TABLE 1

| Comparative example number | AgBeh [g/m²] | PVB [g/m²] | PVB AgBeh | $SiO_2$ AgBeh | R1 [g/m²] | TA1 [g/m²] | Oil [g/m²] | S1 [g/m²] | S2 [g/m²] | R812 [g/m²] |
|---|---|---|---|---|---|---|---|---|---|---|
| 1 | 4.27 | 12.80 | 3 | 0 | 1.008 | 0.310 | 0.0389 | 0.137 | 0.446 | — |

TABLE 2

| Invention example number | AgBeh [g/m²] | PVB [g/m²] | PVB AgBeh | $SiO_2$ AgBeh | R1 [g/m²] | TA1 [g/m²] | Oil [g/m²] | S1 [g/m²] | S2 [g/m²] | R812 [g/m²] |
|---|---|---|---|---|---|---|---|---|---|---|
| 1 | 5.40 | 16.20 | 3 | 0.4 | 1.275 | 0.392 | 0.0491 | 0.173 | 0.563 | 2.160 |
| 2 | 5.19 | 15.57 | 3 | 0.75 | 1.228 | 0.377 | 0.0473 | 0.166 | 0.542 | 3.892 |
| 3 | 5.53 | 15.29 | 3 | 1 | 1.307 | 0.402 | 0.0504 | 0.177 | 0.578 | 5.532 |

The coating quality of the resulting coatings was evaluated using haze and gloss measurements to ascertain whether the presence of relatively large quantities of finely divided silicon dioxide had an adverse effect on their transparency. Percentage Haze was determined according to ASTM standard D1003 procedure B using a Diano Matchscan Corporation Matchscan spectrophotometer according to the expression:

$$\text{Haze, } \% = (T_d/T_t) \times 100$$

where $T_d$ is the diffuse luminous transmittance and $T_t$ is the total luminous transmittance. The $T_d$ and $T_t$ values from the haze measurement were then used to calculate the gloss according to the expression:

$$\text{gloss} = (T_t - T_d) \times 100$$

The haze and gloss values for the layers of COMPARATIVE EXAMPLE 1 and INVENTION EXAMPLES 1 to 3 are summarized below:

| | % Haze | Gloss |
|---|---|---|
| COMPARATIVE EXAMPLE number 1: | 16.13 | 43.44 |
| INVENTION EXAMPLE number 1: | 14.46 | 47.59 |
| INVENTION EXAMPLE number 2: | 16.06 | 40.30 |
| INVENTION EXAMPLE number 3: | 11.32 | 47.47 |

It is evident from these measurements that the presence of finely divided silicon dioxide in the coatings surprisingly had no adverse effects on their transparency.

Thermographic printing

The printer was equipped with a thin film thermal head with a resolution of 300 dpi and was operated with a line time of 19 ms (the line time being the time needed for printing one line). During the line time the print head received constant power. The average printing power, being the total amount of electrical input energy during one line time divided by the line time and by the surface area of the heat-generating resistors was 1.5 mJ/dot being sufficient to obtain maximum optical density in each of the recording materials.

During printing the print head was separated from the imaging layer by a thin intermediate material contacted with a slipping layer of a separable 5 μm thick polyethylene terephthalate ribbon coated successively with a subbing layer, heat-resistant layer and the slipping layer (anti-friction layer) giving the ribbon with a total thickness of 6 μm.

image evaluation

The optical maximum and minimum densities of the prints given in table II were measured through a visual filter with a Macbeth™ TD904 densitometer in the grey scale step corresponding to data levels of 255 and 0 respectively.

For evaluating the tone reproduction capabilities of the thermosensitive recording materials of COMPARATIVE EXAMPLE 1 and INVENTION EXAMPLES 1 to 3, the numerical gradation value (NGV) corresponding to the expression: $(2.5-0.06)/(E_{2.5}-E_{0.06})$ was determined; where $E_{2.5}$ is that energy in Joule applied to a dot area of 87 μm×87 μm of the recording material required to obtain an optical density value of 2.5 as measured with a Macbeth™ TD904 densitometer, and $E_{0.06}$ is that energy in Joule applied to a dot area of 87 μm×87 μm of the recording material required to obtain an optical density value of 0.06 as measured with a Macbeth™ TD904 densitometer. The applied energy in Joule is actually the electrical input energy measured for each resistor of the thermal head.

For evaluating the colour neutrality the optical density (D) of the obtained images is measured with blue, green and red filter using a densitometer MacBeth™ TD904. As a result thereof in order of increasing magnitude optical density values $D_1$, $D_2$ and $D_3$ were obtained. Using these values in the following equation a numerical colour value (NCV) was obtained:

$$NCV = \frac{D_1 \times D_2}{(D_3)^2}$$

Maximal colour neutrality corresponds with a NCV value of 1. The larger the NCV value the better the colour neutrality of the obtained image. NCV values were determined at optical densities (D) of 1, 2 and 3.

The results obtained with the recording materials of COMPARATIVE EXAMPLE 1 and INVENTION EXAMPLES 1 to 3 are given in tables 3 and 4 respectively.

TABLE 3

| Comparative example number | PVB AgBeh | $SiO_2$ AgBeh | image characteristics printing with fresh material $D_{max}$ | $D_{min}$ | NCV at D = 1 | NCV at D = 2 | NCV at D = 3 | NGV |
|---|---|---|---|---|---|---|---|---|
| 1 | 3 | 0 | 2.74 | 0.04 | 0.94 | 0.96 | 0.92 | 2.67 |

TABLE 4

| Invention example number | PVB AgBeh | $SiO_2$ AgBeh | image characteristics printing with fresh material $D_{max}$ | $D_{min}$ | NCV at D = 1 | NCV at D = 2 | NCV at D = 3 | NGV |
|---|---|---|---|---|---|---|---|---|
| 1 | 3 | 0.4 | 3.04 | 0.04 | 0.91 | 0.96 | 0.95 | 2.90 |
| 2 | 3 | 0.75 | 3.36 | 0.05 | 0.93 | 0.93 | 0.91 | 3.18 |
| 3 | 3 | 1 | 3.85 | 0.06 | 0.93 | 0.89 | 0.83 | 3.52 |

From these results it is clear that the incorporation of finely divided silicon dioxide in the thermosensitive element in $SiO_2$/AgBeh weight ratios between fifteen thousandths of the PVB/AgBeh weight ratio and 1.2 of the PVB/AgBeh weight ratio less 0.4 produces a significant increase in the numerical gradation value, NGV, without adversely affecting the numerical color value and other imaging characteristics.

INVENTION EXAMPLE 4 AND COMPARATIVE EXAMPLES 2 TO 4

The recording materials of INVENTION EXAMPLE 4 and COMPARATIVE EXAMPLES 2 to 4 were produced as described for INVENTION EXAMPLES 1 to 3 and COMPARATIVE EXAMPLE 1, but with different quantities of the same ingredients in the thermosensitive element as summarised in tables 5 and 6 for the COMPARATIVE EXAMPLES and INVENTION EXAMPLE respectively. The ingredient quantities for the thermosensitive element of the recording material of INVENTION EXAMPLE 3 are included in table 6 for the sake of comparison.

TABLE 5

| Comparative example number | AgBeh [g/m²] | PVB [g/m²] | PVB AgBeh | $SiO_2$ AgBeh | R1 [g/m²] | TA1 [g/m²] | Oil [g/m²] | S1 [g/m²] | S2 [g/m²] | R812 [g/m²] |
|---|---|---|---|---|---|---|---|---|---|---|
| 2 | 5.37 | 21.49 | 4 | 0 | 1.270 | 0.390 | 0.0490 | 0.172 | 0.562 | — |
| 3 | 5.80 | 11.59 | 2 | 2 | 1.369 | 0.421 | 0.0538 | 0.185 | 0.606 | 11.57 |
| 4 | 5.80 | 8.69 | 1.5 | 2.5 | 1.370 | 0.421 | 0.0517 | 0.186 | 0.607 | 14.47 |

TABLE 6

| Invention example number | AgBeh [g/m²] | PVB [g/m²] | PVB AgBeh | $SiO_2$ AgBeh | R1 [g/m²] | TA1 [g/m²] | Oil [g/m²] | S1 [g/m²] | S2 [g/m²] | R812 [g/m²] |
|---|---|---|---|---|---|---|---|---|---|---|
| 3 | 5.53 | 15.59 | 3 | 4 | 1.307 | 0.402 | 0.0504 | 0.177 | 0.578 | 5.532 |
| 4 | 5.72 | 14.29 | 2.5 | 4 | 1.353 | 0.416 | 0.0479 | 0.185 | 0.599 | 8.574 |

The coating quality of the resulting coatings was evaluated using haze and gloss measurements as described for INVENTION EXAMPLES 1 to 3 with the following results together with those for INVENTION EXAMPLE 3 for the sake of comparison:

| | % Haze | Gloss |
|---|---|---|
| COMPARATIVE EXAMPLE number 2: | 13.47 | 55.40 |
| COMPARATIVE EXAMPLE number 3: | white layer | |
| COMPARATIVE EXAMPLE number 4: | white layer | |
| INVENTION EXAMPLE number 3: | 11.32 | 47.47 |
| INVENTION EXAMPLE number 4: | 22.00 | 30.78 |

It is evident from these measurements that the presence of finely divided silicon dioxide in the coatings within the concentration limits specified surprisingly had no adverse effects on their transparency. However, at silicon dioxide concentrations at or above 1.2 of the PVB/AgBeh weight ratio less 0.4 there is a severe loss of transparency as shown by the whiteness of the resulting thermosensitive elements of the recording materials of COMPARATIVE EXAMPLES 3 and 4.

Thermographic printing

Printing was carried out with these recording materials and the evaluation of the resulting prints was carried out as described for INVENTION EXAMPLES 1 to 3 and COM- PARATIVE EXAMPLE 1. The resulting imaging characteristics are summarized in tables 7 and 8 for the COMPARATIVE EXAMPLES and INVENTION EXAMPLE respectively. The imaging results of the recording material of INVENTION EXAMPLE 3 are included in table 8 for the sake of comparison.

TABLE 7

| Comparative example number | PVB AgBeh | $SiO_2$ AgBeh | image characteristics printing with fresh material | | | | | |
|---|---|---|---|---|---|---|---|---|
| | | | $D_{max}$ | $D_{min}$ | NCV at D = 1 | NCV at D = 2 | NCV at D = 3 | NGV |
| 2 | 4 | 0 | 2.50 | 0.04 | 0.96 | 0.95 | 0.93 | 2.53 |
| 3 | 2 | 2 | white layer due to too high $SiO_2$ content | | | | | |
| 4 | 1.5 | 2.5 | white layer due to too high $SiO_2$ content | | | | | |

TABLE 8

| Invention example number | PVB AgBeh | $SiO_2$ AgBeh | image characteristics printing with fresh material | | | | | |
|---|---|---|---|---|---|---|---|---|
| | | | $D_{max}$ | $D_{min}$ | NCV at D = 1 | NCV at D = 2 | NCV at D = 3 | NGV |
| 3 | 3 | 1 | 3.85 | 0.06 | 0.93 | 0.89 | 0.83 | 3.52 |
| 4 | 2.5 | 1.5 | 3.37 | 0.05 | 0.91 | 0.98 | 0.96 | 3.4 |

From these results it is clear that the incorporation of finely divided silicon dioxide in the thermosensitive element in $SiO_2$/AgBeh weight ratios between fifteen thousandths of the PVB/AgBeh weight ratio and 1.2 of the PVB/AgBeh weight ratio less 0.4 produces a significant increase in the numerical gradation value, NGV, without adversely affecting the numerical color value and other imaging characteristics.

INVENTION EXAMPLES 5 AND 6 AND COMPARATIVE EXAMPLE 5

The recording materials of INVENTION EXAMPLES 5 and 6 and COMPARATIVE EXAMPLE 5 were produced as described for INVENTION EXAMPLES 1 to 3 and COMPARATIVE EXAMPLE 1, but with different quantities of the same ingredients in the thermosensitive element as summarised in tables 9 and 10 for the COMPARATIVE EXAMPLES and INVENTION EXAMPLE respectively.

TABLE 9

| Comparative example number | AgBeh [g/m²] | PVB [g/m²] | PVB AgBeh | $SiO_2$ AgBeh | R1 [g/m²] | TA1 [g/m²] | Oil [g/m²] | S1 [g/m²] | S2 [g/m²] | R812 [g/m²] |
|---|---|---|---|---|---|---|---|---|---|---|
| 5 | 4.27 | 4.27 | 1 | 0 | 1.008 | 0.310 | 0.0389 | 0.137 | 0.446 | — |

TABLE 10

| Invention example number | AgBeh [g/m²] | PVB [g/m²] | PVB AgBeh | $SiO_2$ AgBeh | R1 [g/m²] | TA1 [g/m²] | Oil [g/m²] | S1 [g/m²] | S2 [g/m²] | R812 [g/m²] |
|---|---|---|---|---|---|---|---|---|---|---|
| 5 | 6.64 | 6.64 | 1 | 0.15 | 1.568 | 0.482 | 0.0605 | 0.213 | 0.694 | 0.996 |
| 6 | 6.22 | 6.22 | 1 | 0.30 | 1.469 | 0.452 | 0.0567 | 0.199 | 0.649 | 1.864 |

The coating quality of the resulting coatings was evaluated using haze and gloss measurements as described for INVENTION EXAMPLES 1 to 3 with the following results:

| | % Haze | Gloss |
|---|---|---|
| COMPARATIVE EXAMPLE number 5: | 24.46 | 30.47 |
| INVENTION EXAMPLE number 5: | 31.20 | 25.97 |
| INVENTION EXAMPLE number 6: | 27.83 | 23.42 |

It is evident from these measurements that the presence of finely divided silicon dioxide in the coatings within the concentration limits specified surprisingly had no adverse effects on their transparency.

Thermographic printing

Printing was carried out with these recording materials and the evaluation of the resulting prints was carried out as described for INVENTION EXAMPLES 1 to 3 and COMPARATIVE EXAMPLE 1. The resulting imaging characteristics are summarized in tables 11 and 12 for the COMPARATIVE EXAMPLES and INVENTION EXAMPLE respectively.

TABLE 11

| Comparative example number | PVB AgBeh | $SiO_2$ AgBeh | image characteristics printing with fresh material | | | | | |
|---|---|---|---|---|---|---|---|---|
| | | | $D_{max}$ | $D_{min}$ | NCV at D = 1 | NCV at D = 2 | NCV at D = 3 | NGV |
| 5 | 1 | 0 | 2.54 | 0.05 | 0.84 | 0.97 | 0.89 | 2.41 |

TABLE 12

| Invention example number | PVB AgBeh | $SiO_2$ AgBeh | image characteristics printing with fresh material | | | | | |
|---|---|---|---|---|---|---|---|---|
| | | | $D_{max}$ | $D_{min}$ | NCV at D = 1 | NCV at D = 2 | NCV at D = 3 | NGV |
| 5 | 1 | 0.15 | 3.74 | 0.05 | 0.86 | 0.90 | 0.95 | 4.11 |
| 6 | 1 | 0.30 | 3.83 | 0.06 | 0.86 | 0.88 | 0.94 | 4.29 |

From these results it is clear that the incorporation of finely divided silicon dioxide in the thermosensitive element in $SiO_2$/AgBeh weight ratios between fifteen thousandths of the PVB/AgBeh weight ratio and 1.2 of the PVB/AgBeh weight ratio less 0.4 produces a significant increase in the numerical gradation value, NGV, without adversely affecting the numerical color value and other imaging characteristics.

INVENTION EXAMPLE 7 AND COMPARATIVE EXAMPLES 7 AND 8

The recording materials of INVENTION EXAMPLE 7 and COMPARATIVE EXAMPLES 7 and 8 were produced as described for INVENTION EXAMPLES 1 to 3 and COMPARATIVE EXAMPLE 1, but with different quantities of the same ingredients in the thermosensitive element as summarised in tables 13 and 14 for the COMPARATIVE EXAMPLES and INVENTION EXAMPLE respectively. The ingredient quantities for the thermosensitive element of the recording material of COMPAPATIVE EXAMPLE 2 are included in table 13 for the sake of comparison.

TABLE 13

| Comparative example number | AgBeh [g/m$^2$] | PVB [g/m$^2$] | PVB AgBeh | $SiO_2$ AgBeh | R1 [g/m$^2$] | TA1 [g/m$^2$] | Oil [g/m$^2$] | S1 [g/m$^2$] | S2 [g/m$^2$] | R972 [g/m$^2$] |
|---|---|---|---|---|---|---|---|---|---|---|
| 2 | 5.37 | 21.49 | 4 | 0 | 1.270 | 0.390 | 0.0490 | 0.172 | 0.562 | — |
| 7 | 4.93 | 19.63 | 3.99 | 0.01 | 1.163 | 0.358 | 0.0446 | 0.158 | 0.514 | 0.0496 |
| 8 | 5.24 | 20.91 | 3.99 | 0.03 | 1.236 | 0.380 | 0.0474 | 0.167 | 0.546 | 0.1578 |

TABLE 14

| Invention example number | AgBeh [g/m$^2$] | PVB [g/m$^2$] | PVB AgBeh | $SiO_2$ AgBeh | R1 [g/m$^2$] | TA1 [g/m$^2$] | Oil [g/m$^2$] | S1 [g/m$^2$] | S2 [g/m$^2$] | R972 [g/m$^2$] |
|---|---|---|---|---|---|---|---|---|---|---|
| 7 | 3.82 | 15.26 | 4 | 0.75 | 0.904 | 0.278 | 0.0348 | 0.122 | 0.399 | 2.865 |

The coating quality of the resulting coatings was evaluated using haze and gloss measurements as described for INVENTION EXAMPLES 1 to 3 and COMPARATIVE EXAMPLE 1 with the following results together with those for COMPARATIVE EXAMPLE 2 for the sake of comparison:

| | % Haze | Gloss |
|---|---|---|
| COMPARATIVE EXAMPLE number 2: | 13.47 | 55.40 |
| COMPARATIVE EXAMPLE number 7: | 4.20 | 73.07 |
| COMPARATIVE EXAMPLE number 8: | 4.31 | 72.28 |
| INVENTION EXAMPLE number 7: | 7.62 | 98.29 |

It is evident from these measurements that the presence of finely divided silicon dioxide in the coatings within the concentration limits specified surprisingly had no adverse effects on their transparency.

Thermographic printing

Printing was carried out with these recording materials and the evaluation of the resulting prints was carried out as described for INVENTION EXAMPLES 1 to 3 and COMPARATIVE EXAMPLE 1. The resulting imaging characteristics are summarized in tables 15 and 16 for the COMPARATIVE EXAMPLES and INVENTION EXAMPLE respectively. The imaging results for the recording material of COMPARATIVE EXAMPLE 2 are included in table 15 for the sake of comparison.

TABLE 15

| Comparative example number | PVB AgBeh | $SiO_2$ AgBeh | image characteristics printing with fresh material | | | | | |
|---|---|---|---|---|---|---|---|---|
| | | | $D_{max}$ | $D_{min}$ | NCV at D = 1 | NCV at D = 2 | NCV at D = 3 | NGV |
| 2 | 4 | 0 | 2.50 | 0.04 | 0.96 | 0.95 | 0.93 | 2.53 |
| 7 | 3.99 | 0.01 | 2.86 | 0.04 | 0.86 | 0.78 | — | 2.45 |
| 8 | 3.99 | 0.03 | 2.88 | 0.05 | 0.91 | 0.84 | — | 2.67 |

TABLE 16

| Invention example number | PVB AgBeh | $SiO_2$ AgBeh | image characteristics printing with fresh material | | | | | |
|---|---|---|---|---|---|---|---|---|
| | | | $D_{max}$ | $D_{min}$ | NCV at D = 1 | NCV at D = 2 | NCV at D = 3 | NGV |
| 7 | 4 | 0.75 | 2.92 | 0.04 | 0.92 | 0.82 | 0.69 | 2.99 |

From these results it is clear that the incorporation of finely divided silicon dioxide in the thermosensitive element at $SiO_2$/AgBeh weight ratios at of below fifteen thousandths of the PVB/AgBeh weight ratio has no significant effect on the numerical gradation value, NGV. However, in the range above this value and below 1.2 of the PVB/AgBeh weight ratio less 0.4 at which a loss of thermosensitive element transparency was observed, a significant increase in the numerical gradation value, NGV, was observed without any adverse effect on the thermosensiti0-ve element transparency and on imaging characteristics such as the numerical color value, maximum print density and minimum print density.

Having described in detail preferred embodiments of the current invention, it will now be apparent to those skilled in the art that numerous modifications can be made therein without departing from the scope of the invention as defined in the following claims.

We claim:

1. A recording material comprising at least one thermosensitive element, comprising a layer comprising at least one substantially light-insensitive organic silver salt in at least one binder and in thermal working relationship therewith an organic reducing agent therefor, on a support, characterized in that said recording material is light-insensitive and said layer contains colloidal particles comprising silicon dioxide at a coating weight given by expression (1):

$$0.015 \times \frac{B}{AGOS} < \frac{S}{AGOS} < 1.2 \frac{(B}{AGOS} - 0.4) \quad (1)$$

wherein B represents the total weight of all binders in said layer, AGOS represents the total weight of all organic silver salts in said layer and S represents the weight of said colloidal particles in said layer.

2. A recording material according to claim 1, wherein said layer contains colloidal particles comprising silicon dioxide at a coating weight given by expression (2):

$$0.1 \times \frac{B}{AGOS} < \frac{S}{AGOS} < 1.0 \left( \frac{B}{AGOS} - 0.4 \right) \quad (2)$$

wherein B represents the total weight of all binders in said layer, AGOS represents the total weight of all organic silver salts in said layer and S represents the weight of said colloidal particles in said layer.

3. A recording material according to claim 1, wherein said layer contains said colloidal particles at a coating weight given by expression (3):

$$0.2 \times \frac{B}{AGOS} < \frac{S}{AGOS} < 0.8 \left( \frac{B}{AGOS} - 0.4 \right) \quad (3)$$

wherein B represents the total weight of all binders in said layer, AGOS represents the total weight of all organic silver salts in said layer and S represents the weight of said colloidal particles in said layer.

4. A recording material according to claim 1, wherein said colloidal particles are hydrophobized.

5. A recording material according to claim 1, wherein said colloidal particles have a specific surface area greater than 100 $m^2/g$.

6. A recording material according to claim 1, wherein said recording material has a haze value, determined according to ASTM standard D1003 procedure B, of less than 35%.

7. A recording material according to claim 1, wherein said thermosensitive element comprises in addition at least one polycarboxylic acid and/or anhydride thereof in a molar percentage of at least 20 with respect to all said organic silver salt(s) present and in thermal working relationship therewith.

8. A recording material according to claim 1, wherein said substantially light-insensitive organic silver salt is a substantially light-insensitive fatty acid silver salt.

9. A thermal image forming process for producing high contrast images comprising the steps of: (i) bringing an outermost layer of a recording material comprising at least one thermosensitive element, comprising a layer comprising a substantially light-insensitive organic silver salt in at least one binder and in thermal working relationship therewith an organic reducing agent therefor, on a support; (2) applying heat from a heat source image-wise to said recording material while maintaining mutual contact to said heat source; and (3) separating said recording material from said heat source, characterized in that said recording material is light-insensitive and said layer contains colloidal particles comprising silicon dioxide at a coating weight given by expression (1):

$$0.015 \times \frac{B}{AGOS} < \frac{S}{AGOS} < 1.2 \left( \frac{B}{AGOS} - 0.4 \right) \quad (1)$$

wherein B represents the total weight of all binders in said layer, AGOS represents the total weight of all organic silver salts in said layer and S represents the weight of colloidal particles in said layer.

10. A thermal image forming process according to claim 9, wherein said heat source is a thermal head.

* * * * *